US007546829B2

(12) United States Patent
Samoto et al.

(10) Patent No.: US 7,546,829 B2
(45) Date of Patent: Jun. 16, 2009

(54) STRADDLE TYPE VEHICLE

(75) Inventors: Haruhiko Samoto, Shizuoka (JP); Hirokazu Fujita, Shizuoka (JP); Harutomo Tozuka, Shizuoka (JP); Takeshi Matsuda, Shizuoka (JP)

(73) Assignee: Yamaha Hatsudoki Kabushiki Kaisha, Iwata-shi, Shizuoka-ken (JP)

( * ) Notice: Subject to any disclaimer, the term of this patent is extended or adjusted under 35 U.S.C. 154(b) by 0 days.

(21) Appl. No.: 12/212,548

(22) Filed: Sep. 17, 2008

(65) Prior Publication Data

US 2009/0071437 A1 Mar. 19, 2009

(30) Foreign Application Priority Data

Sep. 18, 2007 (JP) ..... 2007-241056
Dec. 26, 2007 (JP) ..... 2007-333496
Apr. 22, 2008 (JP) ..... 2008-111467

(51) Int. Cl.
*F02D 9/02* (2006.01)
*F02D 45/00* (2006.01)

(52) U.S. Cl. ..... 123/399; 123/361; 123/400; 180/219

(58) Field of Classification Search ..... 123/336, 123/399, 400, 403, 361, 337; 180/219, 170
See application file for complete search history.

(56) References Cited

U.S. PATENT DOCUMENTS 5,678,651 A 10/1997 Kogiso
7,159,564 B2 * 1/2007 Yanagii ..... 123/400
7,168,517 B2 * 1/2007 Udono ..... 180/219
7,311,082 B2 * 12/2007 Yokoi ..... 123/399
7,318,410 B2 * 1/2008 Yokoi ..... 123/399
7,320,305 B2 * 1/2008 Alberghini et al. ..... 123/336
7,431,013 B2 * 10/2008 Hotta et al. ..... 123/399
7,461,630 B2 * 12/2008 Maruo et al. ..... 123/397
2007/0169744 A1 7/2007 Maruo et al.

FOREIGN PATENT DOCUMENTS

EP 1 688 604 A1 8/2006
EP 1 719 891 A2 11/2006
JP 2002-67741 3/2002
WO WO2005/047671 A1 5/2005

OTHER PUBLICATIONS

European Search Report, Oct. 31, 2008, for European Patent Application No. EP 08 25 3051.

* cited by examiner

*Primary Examiner*—Stephen K. Cronin
*Assistant Examiner*—Johnny H. Hoang
(74) *Attorney, Agent, or Firm*—Jones Day

(57) ABSTRACT

A straddle type vehicle includes a protrusion which is displaced together with a throttle valve, a lever pulley which is displaced in response to the rotation of a throttle grip, a spring and a control device. The spring generates elastic force to return the protrusion to a first original position when the lever pulley is in a second original position. The spring maintains the lever pulley in the second original position by being elastically deformed until the protrusion reaches a predetermined position in which the protrusion is displaced from the first original position in such a direction that the throttle valve opens when the lever pulley is in the second original position. The control device opens the throttle valve by displacing the protrusion until the protrusion reaches the predetermined position in a gear shift change when the throttle grip is fully closed.

9 Claims, 11 Drawing Sheets

STRADDLE TYPE VEHICLE

PRIORITY INFORMATION

This patent application claims priority under 35 U.S.C. §119 to Japanese Patent Application No. 2007-241056, filed on Sep. 18, 2007, Japanese Patent Application No. 2007-333496, filed on Dec. 26, 2007, and Japanese Patent Application No. 2008-111467, filed on Apr. 22, 2008, the entire contents of which are hereby expressly incorporated by reference.

TECHNICAL FIELD

The present invention relates to a straddle type vehicle.

BACKGROUND ART

Conventionally, in a straddle type vehicle, such as a two-wheel motor vehicle, an electronic throttle valve system that controls a throttle valve automatically has been known for some time. See, for example, Japanese patent publication JP WO2005/047671 A1 of May 26, 2005.

The electronic throttle valve system enables control of the throttle valve regardless of the operation of the acceleration grip and the like by a rider. This allows for advanced throttle control compared to conventional systems.

SUMMARY

The present invention was made in consideration of the above points. An object of the present invention is to provide a straddle type vehicle with an electronic throttle valve that is capable of providing advanced throttle control compared to the conventional vehicles. A straddle type vehicle according to one aspect of the present invention comprises a throttle valve for adjusting the amount of air intake of an engine; an acceleration controller operated by a rider for opening and closing the throttle valve; an electric motor for actuating the throttle valve; a first member displaced together with the throttle valve, the first member having a first original position when the throttle valve is fully closed; a second member displaced in accordance with the acceleration controller, the second member having a second original position when the acceleration controller is fully closed; an elastic body interposed between the first member and the second member when at least the first member and the second member are in the first original position and the second original position, respectively, the elastic body generating a restoring force to return the first member to the first original position when the second member is in the second original position, and maintaining the second member in the second original position by being elastically deformed until the first member reaches a predetermined position when the first member is displaced from the first original position in a direction in which the throttle valve opens in a state in which the second member is in the second original position; and a control device responsive to a predetermined control signal for opening the throttle valve by driving the electric motor and displacing the first member until the first member reaches at most the predetermined position.

The straddle type vehicle may further include a multistage transmission; an input device for receiving a gear shift change command from the rider; and a gear shift actuator for driving the transmission to perform a gear shift change when the gear shift change command is input in the input device, and the predetermined control signal may be a signal generated when a gear shift change is performed by the shift actuator when the acceleration controller is fully closed.

According to the straddle type vehicle as described above, even when the second member is in the second original position, since the acceleration controller is fully closed, the throttle valve may be opened without displacing the second member. This allows for so-called blipping in which the rotational speed of an engine is temporarily increased by opening the throttle valve sharply and temporarily even without a special blipper. Thus, a quick gear shift change is achieved by performing the blipping at gear shift changes.

In addition, according to the straddle type vehicle as described above, blipping may be performed using the first member, the second member, and the elastic body each of which is used for functions other than blipping. This allows for blipping without providing a special blipper for blipping.

The straddle type vehicle may further include a vehicle speed sensor for detecting the vehicle speed, and the predetermined control signal may be a control signal for adjusting the opening of the throttle valve so that the vehicle speed becomes a predetermined value in a range in which the first member is positioned between the first original position and the predetermined position.

According to this straddle type vehicle, the vehicle speed can be maintained at a predetermined setting regardless of the opening of the acceleration controller. This allows for a so-called cruise control.

The straddle type vehicle may further include a multistage transmission; a drive wheel; a driven wheel; a first sensor for detecting a rotational speed of the drive wheel; and a second sensor for detecting a rotational speed of the driven wheel, whereby the predetermined control signal may be a control signal for adjusting the opening of the throttle valve so that the difference between the rotational speed of the drive wheel and the rotational speed of the driven wheel is not greater than a predetermined value during a down gear shift of the transmission.

According to the above-described straddle type vehicle, when the difference between the rotational speed of the drive wheel and the rotational speed of the driven wheel exceeds a predetermined setting during a down gear shift, the opening of the throttle valve is adjusted so that the speed difference is not greater than the predetermined setting. In other words, the throttle valve is opened so that the speed difference is not increased. This prevents excessive engine braking.

BRIEF DESCRIPTION OF THE DRAWINGS

FIG. 11 is a graphic illustration of engine braking control, wherein FIG. 11A shows a gear shift pressure change, FIG. 11B shows a gear position change, and FIG. 11C shows the changes of the throttle opening and the acceleration opening.

DETAILED DESCRIPTION

According to the present invention, a straddle type vehicle having an electronic throttle valve and capable of an advanced control compared to conventional vehicles can be achieved.

FIRST EMBODIMENT

For the purpose of eliminating the burden on riders during gear shifting, an Automated Manual Transmission (AMT) which automatically performs the gear shift change by using an actuator has been known. Moreover, in order to improve fuel efficiency and the like, an electronic throttle valve system for automatically controlling a throttle valve has also been known.

In a straddle type vehicle having a multistage transmission, a method for performing a quick gear shift change by performing so-called blipping without disengaging the clutch has been known. Moreover, a method for conducting a smooth gear shift change by performing blipping after disengagement of a clutch at gear shift changes in order to mitigate a shock in the following clutch engagement has also been known. It should be noted that in this specification, the term "blipping" means increasing the rotational speed of an engine temporarily by sharply opening the throttle valve temporarily.

For example, Japanese patent publication JP-A-2002-067741 of Mar. 8, 2002 discloses providing a blipper for idling an engine in a two-wheel motor vehicle having an AMT and an electronic throttle valve.

As described in Japanese patent publication JP-A-2002-067741, blipping can be performed at gear shift changes in a two-wheel motor vehicle provided with an AMT and an electronic throttle valve. However, in these motor vehicles, there has been a problem that a special blipper (for blipping) has to be additionally provided.

The straddle type vehicle according to the present embodiment advantageously overcomes this problem without providing a special blipper in a straddle type vehicle having an AMT and an electronic throttle valve.

Figure 1:
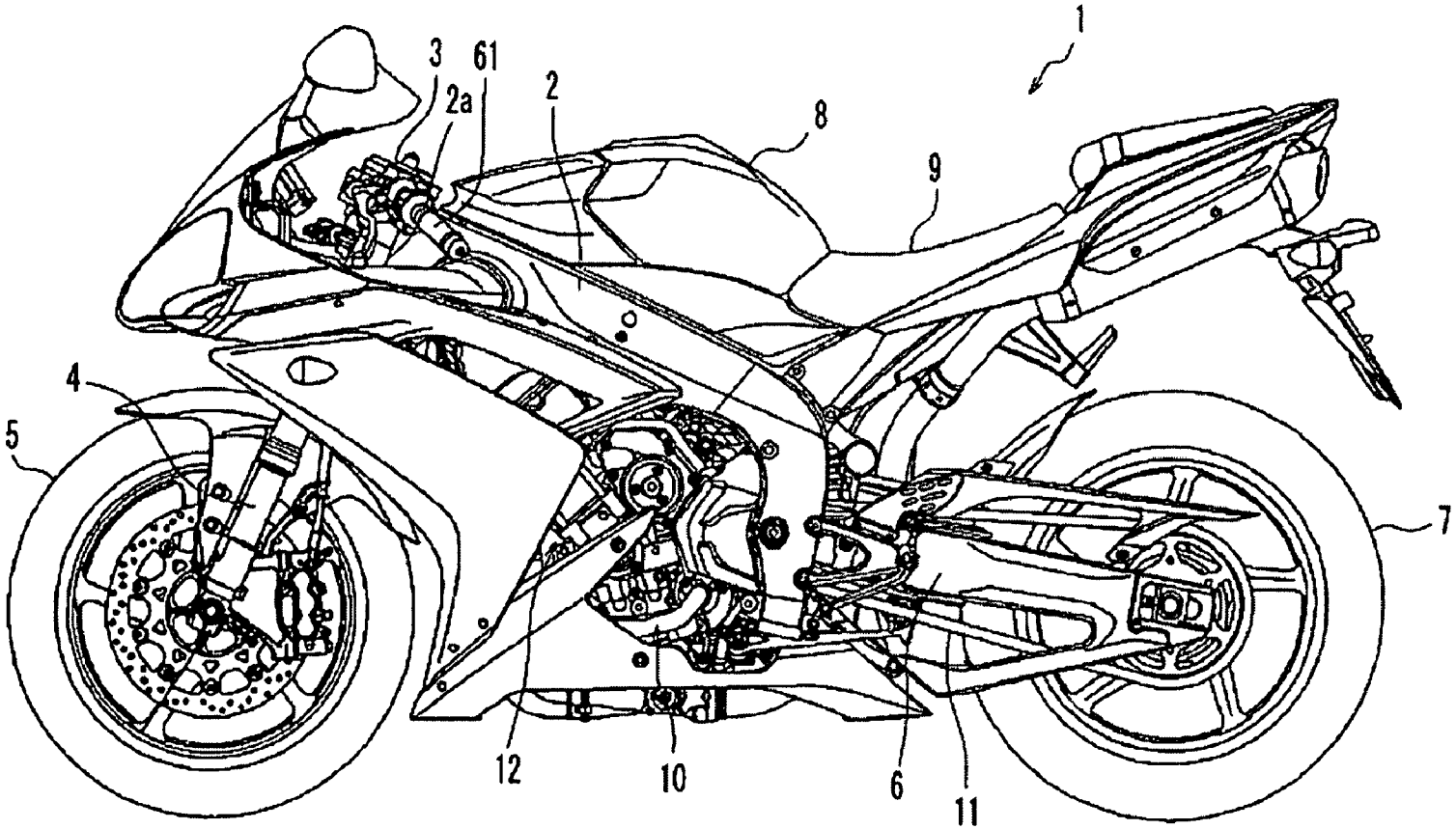
FIG. 1 is a left side view of a two-wheel straddle type motor vehicle according to an embodiment.

Hereinafter, a straddle type vehicle according to the present embodiment will be described in detail with reference to the appended drawings. More particularly, a two-wheel motor vehicle 1 of a motorcycle type, as shown in FIG. 1, will be described as an example of a straddle type vehicle embodying the present invention. However, the two-wheel motor vehicle 1 does not have to be limited to the presently described embodiment(s). For example, two-wheel motor vehicle 1 may be of the moped type, scooter type, off-road type and/or the like, i.e. other than the so-called motorcycle type. The invention is also not limited to two-wheel straddle type vehicles, but may be applied to straddle type vehicles generally.

Configuration Of Two-Wheel Motor Vehicle 1

FIG. 1 is a left side view of a two-wheel motor vehicle 1 according to a first embodiment. With reference to FIG. 1, the general configuration of the two-wheel motor vehicle 1 will be described. In the following description, general directions such as "front," "rear," "left," and "right" refer to directions being viewed by a rider sitting on seat 9.

The two-wheel motor vehicle 1 includes a body frame 2 which has a head pipe 2*a*. A handle bar 3 is mounted on an upper end of the head pipe 2*a*, and a front wheel 5 is mounted to a lower end of the head pipe 2*a* through front forks 4 in a freely rotatable manner. A swing arm 6 capable of oscillating is attached to a rear end of the body frame 2. A rear wheel 7 is mounted in a rotatable manner to the rear end of the swing arm 6.

A fuel tank 8 is mounted to the body frame behind the head pipe 2*a*. A seat 9 is provided at the rear side of the fuel tank 8.

A power unit 10 including an engine 12 as a driving source is suspended from the body frame 2. The power unit 10 is operatively connected to the rear wheel 7 through a power transmission means 11 such as a chain, a belt and a drive shaft. This allows the power transmission means 11 to transmit driving force to the rear wheel 7, the driving force being generated in the power unit 10 by the engine 12.

(Power Unit 10)

Figure 2:
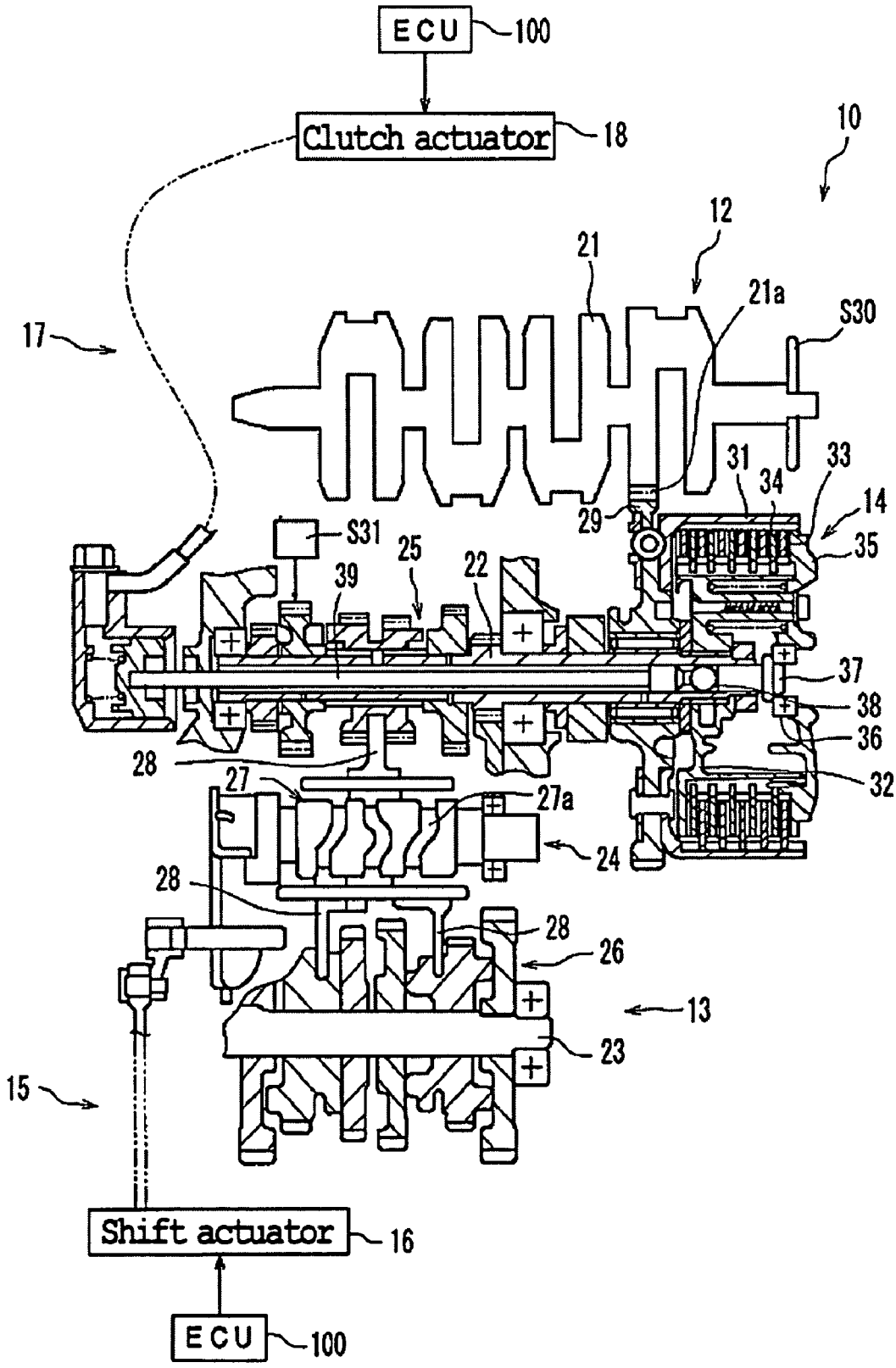
FIG. 2 shows a configuration of a power unit according to the embodiment of FIG. 1.

Next, referring mainly to FIG. 2, an exemplary configuration of the power unit 10 will be described in detail. As shown in FIG. 2, the power unit 10 includes the engine 12, a transmission 13 and a clutch 14. In this invention, the type of engine employed is not particularly limited. In this embodiment, an example is described in which the engine 12 is a water-cooled 4-cycle parallel 4-cylinder type engine. However, engine 12 may be of the air-cooled type, and the number of cylinders does not have to be limited to four (4). Moreover, a 2-cycle engine may also be utilized.

Engine 12

Engine 12 is disposed in a manner such that a cylinder shaft (not shown) extends slightly obliquely upward toward the front of the body. Referring to FIG. 2, engine 12 has a crankshaft 21 housed in a crankcase (not shown). The crankshaft 21 is disposed so as to extend in the vehicle-width direction of motor vehicle 1. A rotational engine speed sensor S30 is attached to one end of crankshaft 21. Moreover, the crankshaft 21 is connected to the transmission 13 through the clutch 14.

Transmission 13

Transmission 13 is a multistage transmission and includes a main shaft 22, a drive shaft 23 and a gear selection mechanism 24. The main shaft 22 is connected to the crankshaft 21 through the clutch 14. The main shaft 22 and the drive shaft 23 are each disposed substantially parallel to the crankshaft 21. In addition, a main shaft rotational speed sensor S31 is provided adjacent the main shaft 22.

A plurality of gears 25 are mounted on the main shaft 22. Moreover, a plurality of corresponding gears 26 are mounted on the drive shaft 23. Engagement between the plural gears 25 and the plural gears 26 is achieved only through a pair of selected gears 25 and 26, respectively. Among the plural gears 25 and 26, at least either the gears 25, with the exception of selected gear 25, or the gears 26, with the exception of selected gear 26, are rotatable with respect to the main shaft 22 or the drive shaft 23, respectively. In other words, at least either the unselected gears 25 or the unselected gears 26 idle with respect to the main shaft 22 or the drive shaft 23. Thus, rotational transmission between the main shaft 22 and the drive shaft 23 is achieved only through the selected gears 25 and 26 which engage with each other.

Selection of the gears 25 and 26 is performed by gear selection mechanism 24. More specifically, a shift cam 27 of the gear selection mechanism 24 performs the selection of the gears 25 and 26. A plurality of cam grooves 27*a* are formed on the outer peripheral surface of the shift cam 27. A shift fork 28 is mounted to each cam groove 27*a*. Each shift fork 28 engages with a predetermined gear 25 of the main shaft 22 and a predetermined gear 26 of the drive shaft 23, respectively. When the shift cam 27 is rotated, each of the plural the shift forks 28 is guided (by means of cam groove 27*a*) to move in the axial direction of the main shaft 22. This allows for selection of the gears to engage with each other among the plural gears 25 and 26. More specifically, from the plural gears 25 and 26, only a pair of gears 25 and 26 positioned in accordance with a rotational angle of the shift cam 27 is fixed by a spline with respect to the main shaft 22 and the drive shaft 23. This determines the position of the gears, and, through the gears 25 and 26, rotational transmission of power from engine 12 with a predetermined change gear ratio is performed between the main shaft 22 and the drive shaft 23. This results in power transmission to the rear wheel 7 through the power transmission means 11 shown in FIG. 1, whereby the rear wheel 7 is rotated.

The gear selection mechanism 24 is operatively connected to a shift actuator 16 through a shift power transmission means 15. This allows the shift actuator 16 to drive the gear selection mechanism 24.

Clutch 14

In this embodiment, the clutch 14 is a multi-plate friction clutch which includes a cylindrical clutch housing 31, a cylindrical clutch boss 32, a plurality of friction discs 33 and clutch plates 34 serving as friction plates and a pressure plate 35. Moreover, the clutch 14 includes a gear 29 to mesh with a gear 21 a formed on the crankshaft 21.

The clutch housing 31 is formed in the shape of a cylinder and mounted on the main shaft 22 in a relatively rotatable manner. On an inner peripheral surface of the clutch housing 31, a plurality of grooves extending in the axial direction of the main shaft 22 are formed.

Each friction disc 33 is formed in the shape of a thin-plate ring. A plurality of teeth are formed on the outer periphery of each friction disc 33. Engagement between the plural teeth formed on the outer periphery of the friction disc 33 and the plural grooves formed on the inner peripheral surface of the clutch housing 31 enables each friction disc 33 to be mounted to the clutch housing 31 in a relatively unrotatable manner. Additionally, each friction disc 33 is mounted in a slidable manner in the axial direction of the main shaft 22 with respect to the clutch housing 31.

The clutch boss 32 is formed in the shape of a cylinder and is disposed radially inward of the inner side of clutch housing 31 on the main shaft 22. Moreover, the clutch boss 32 is mounted to the main shaft 22 in a relatively unrotatable manner. On an outer peripheral surface of the clutch boss 32, a plurality of grooves extending in the axial direction of the main shaft 22 are formed.

Each clutch plate 34 is formed in the shape of a thin-plate ring. A plurality of teeth are formed on the inner periphery of each clutch plate 34. Engagement between the plural teeth formed on the inner periphery of the clutch plate 34 and the plural grooves formed on the outer peripheral surface of the clutch boss 32 enables each clutch plate 34 to be mounted to the clutch boss 32 in a relatively unrotatable manner. Additionally, each clutch plate 34 is mounted in a slidable manner in the axial direction of the main shaft 22 with respect to the clutch boss 32.

Each friction disc 33 is mounted to the clutch housing 31 such that its plate surface is substantially orthogonal to the axial direction of the main shaft 22. Each clutch plate 34 is mounted to the clutch boss 32 such that its plate surface is substantially orthogonal to the axial direction of the main shaft 22. Each friction disc 33 and each clutch plate 34 are alternately disposed in the axial direction of the main shaft 22.

The pressure plate 35 is formed substantially in the shape of a disc and mounted in a slidable manner in the axial direction of the main shaft 22 with respect to the clutch boss 32. The pressure plate 35 is mounted in a freely rotatable manner to one end of a push rod 37 (the right side in FIG. 2), which is disposed in the cylindrical main shaft 22, through a bearing 36 such as a deep-grooved ball bearing.

In the cylindrical main shaft 22, a spherical ball 38 adjacent to the other end of the push rod 37 (the left end) is provided. On the left side of the ball 38, a push rod 39 adjacent to the ball 38 is provided.

One end of the push rod 39 (the left end) protrudes from the other end of the cylindrical main shaft 22 (the left end). The protruding one end of the push rod 39 is connected to a clutch actuator 18 through a clutch power transmission means 17.

The shift actuator 16 and the clutch actuator 18 are each connected to a control device 100 and are driven by the control device 100. In FIG. 2, although two control devices 100 are shown for drawing convenience, these components are identical. In the present embodiment, control device 100 comprises an ECU or Electronic Control Unit.

Specifically, when a rider inputs a shift change command into an input device (a shift up switch 61*a* or a shift down switch 61*b* which will be described later), the control device 100 starts shift control. Initially, the control device 100 drives the clutch actuator 18 and disengages the clutch 14 to achieve a disengaged state. Next, the control device 100 drives the shift actuator 16 to cause the gear selection mechanism 24 to select the desired gears 25 and 26. Thereafter, the control device 100 drives the clutch actuator 18 again to engage the clutch 14.

Electronic Throttle Valve System 70

Figure 3:
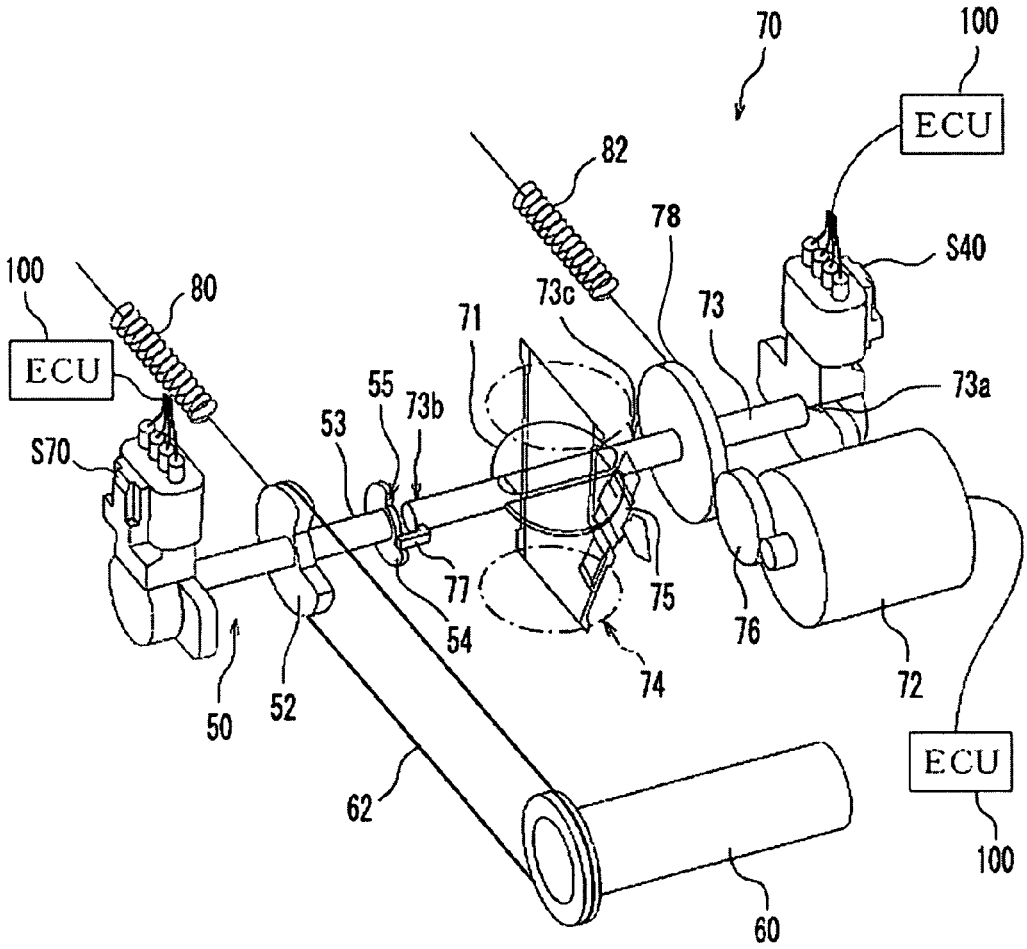
FIG. 3 is a perspective view that schematically shows a configuration of an electronic throttle valve system according to the embodiment of FIG. 1.
Figure 4:
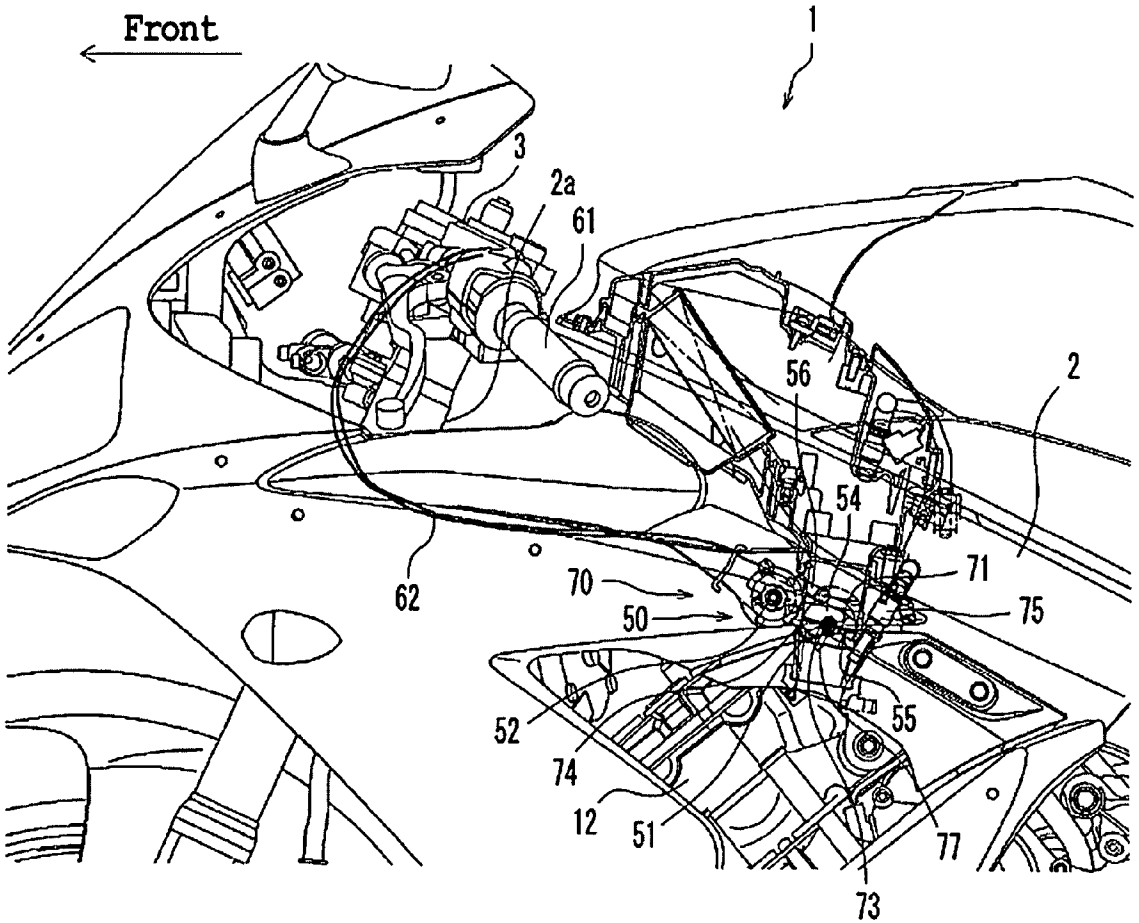
FIG. 4 is a partial side perspective view showing a configuration in which the electronic throttle valve system is mounted on the two-wheel motor vehicle according to the embodiment of FIG. 1.
Figure 5:
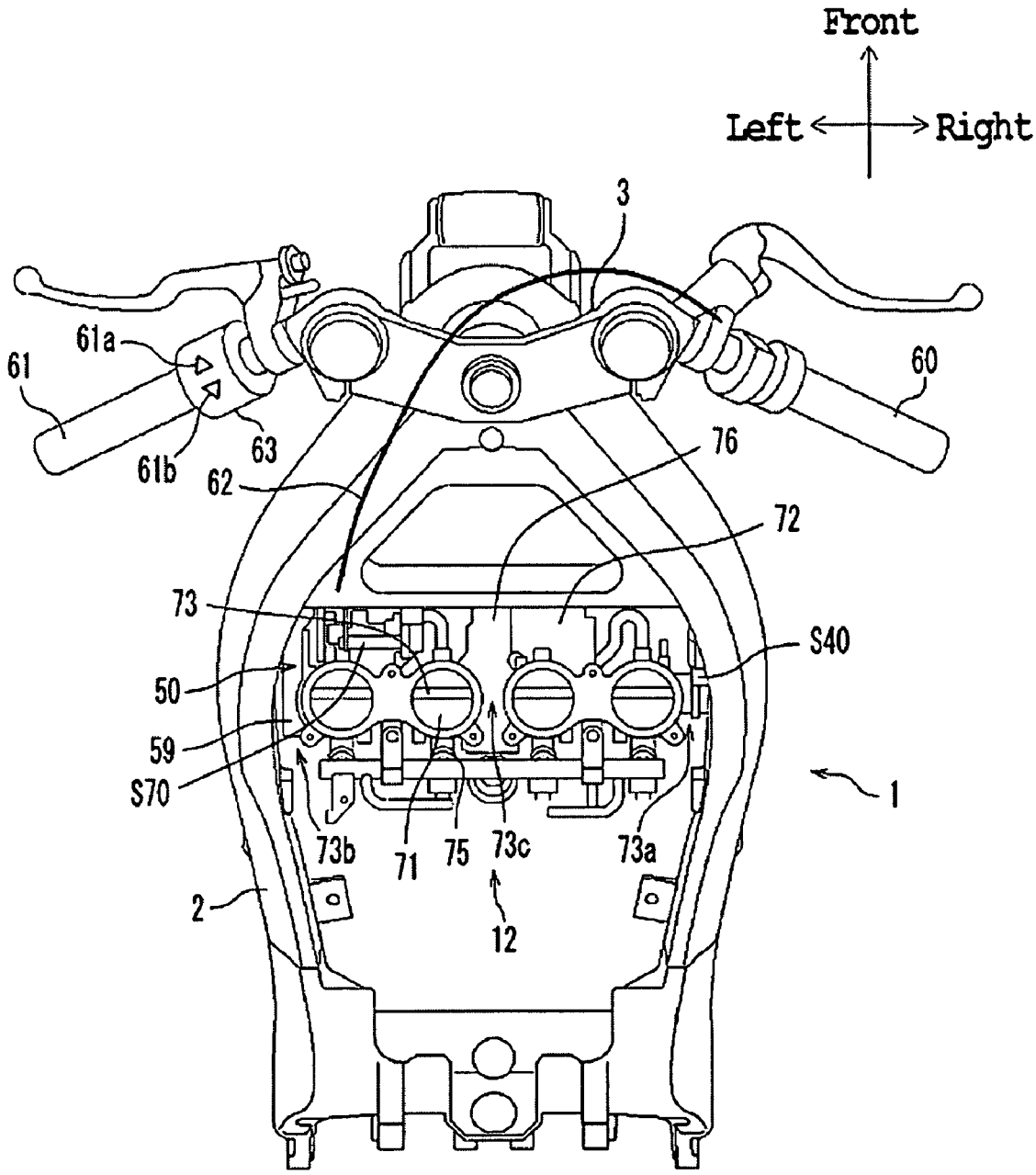
FIG. 5 is a partial plan perspective view of two-wheel motor vehicle according to the embodiment of FIG. 1.

The two-wheel motor vehicle 1 includes an electronic throttle valve system 70 for adjusting the amount of air intake of the engine 12. Hereinafter, with reference to FIGS. 3 through 5, the electronic throttle valve system 70 according to an embodiment of the present invention will be described. FIG. 3 is a perspective view, schematically showing a configuration of the electronic throttle valve system 70 according to this embodiment. FIGS. 4 and 5 are a side perspective view and a plan perspective view, respectively, showing a state in which the electronic throttle valve system 70 according to this embodiment is mounted in the two-wheel motor vehicle 1.

As shown in FIG. 3, the electronic throttle valve system 70 of this embodiment includes a throttle valve 71 for adjusting the amount of air intake of the engine 12 and an electric motor 72 for actuating the throttle valve 71. The electric motor 72 is electrically connected to the control device 100 and driven by the control device 100.

As shown in FIGS. 3 and 4, the throttle valve 71 is fixed to a valve shaft 73. The throttle valve 71 of this embodiment, which is a butterfly throttle valve, is disposed within a throttle body 74. The throttle body 74 is provided with a fuel injection device (an injector) 75 for injecting fuel. FIG. 3 only illustrates one throttle valve 71 for easier understanding although a plurality of throttle valves 71 (equal to the number of cylinders, that is, four throttle valves in this embodiment) may be provided in each of the plurality of throttle bodies 74 (four throttle bodies in this embodiment).

As shown in FIG. 3, the electric motor 72 is operatively connected to the valve shaft 73. In this embodiment, the electric motor 72 is connected to a midsection 73*c* between a right end 73*a* and a left end 73*b* of the valve shaft 73. FIG. 3 illustrates the electric motor 72 connected to the valve shaft 73 through a drive gear 76 and driven gear 78. A return spring 82 is provided in the driven gear 78. With this configuration, the electric motor 72 actuates the throttle valve 71 to be opened and closed.

The valve shaft 73 is also provided with a throttle opening sensor S40 for detecting the opening of the throttle valve 71. In this embodiment, the throttle opening sensor S40 is located on the right end 73*a* of the valve shaft 73. The throttle opening sensor S40 is in electrical connection with the control device 100.

The valve shaft 73 is also provided with a mechanical throttle valve actuating mechanism 50 (hereinafter, it is referred to as "mechanical actuating mechanism 50" for convenience). In this embodiment, the mechanical actuating mechanism 50 is located on the left end 73*b* of the valve shaft 73. The mechanical actuating mechanism 50 is designed to actuate the throttle valve 71 in conjunction with the operation of a throttle grip 60 which is an acceleration controller in the event that the electric motor 72 stops actuating the throttle valve 71.

As shown in FIG. 5, the throttle grip 60, which functions as the acceleration controller, is provided on a right end of the handle bar 3 of two-wheel motor vehicle 1. The throttle grip 60 and the mechanical actuating mechanism 50 are connected by a throttle cable 62 such that the throttle grip 60 and the mechanical actuating mechanism 50 can operate in conjunction with each other.

A grip 61 is provided on a left end of the handle bar 3. On a right end of the grip 61, a switch box 63 is provided. In this embodiment, the switch box 63 has the shift up switch 61*a*and the shift down switch 61*b*, which are input devices for receiving a shift change command from the rider. It should be noted that the input devices are not limited to the shift up switch 61*a*and the shift down switch 61*b*, and other embodiments in various forms are possible.

As shown in FIG. 3, the mechanical actuating mechanism 50 includes a pulley 52, a lever pulley 54 and a shaft portion 53. Moreover, the mechanical actuating mechanism 50 has an accelerator-opening sensor S70 for detecting the displacement of the throttle grip 60 which is the acceleration controller. The accelerator-opening sensor S70 is in electrical communication with the control device 100, and the control device 100 controls the electric motor 72 based on the opening of the accelerator (i.e. the displacement of the throttle grip 60) detected by the accelerator-opening sensor S70. FIG. 3 illustrates three control devices 100 for convenience of description, but indeed there exists only one control device. It should be noted that plural control devices 100 may be connected to one another.

The pulley 52 and the lever pulley 54 are each formed substantially in the shape of a disc in which a part has been notched. Moreover, a center portion of the pulley 52 and a center portion of the lever pulley 54 are connected by the shaft portion 53 in a relatively unrotatable manner. This means that the lever pulley 54 rotates in conjunction with rotation of the pulley 52. The aforementioned throttle cable 62 engages with the pulley 52. In addition, the pulley 52 is provided with a return spring 80. The pulley 52 and the lever pulley 54 are housed in a cover 59 of the mechanical actuating mechanism 50 (see FIG. 5).

In the illustrative configuration shown in FIG. 3, the pulley 52 and the lever pulley 54 are coaxially coupled (through the shaft portion 53). However, the pulley 52 and the lever pulley 54 may be coupled, such that the lever pulley 54 can rotate in conjunction with rotation of the pulley 52. For example, as shown in FIGS. 4 and 6 through 8, the above pulleys may be coupled through a link member 56 capable of varying a lever ratio. Hereinafter, an example using the link member 56 will be described.

Figure 6A:
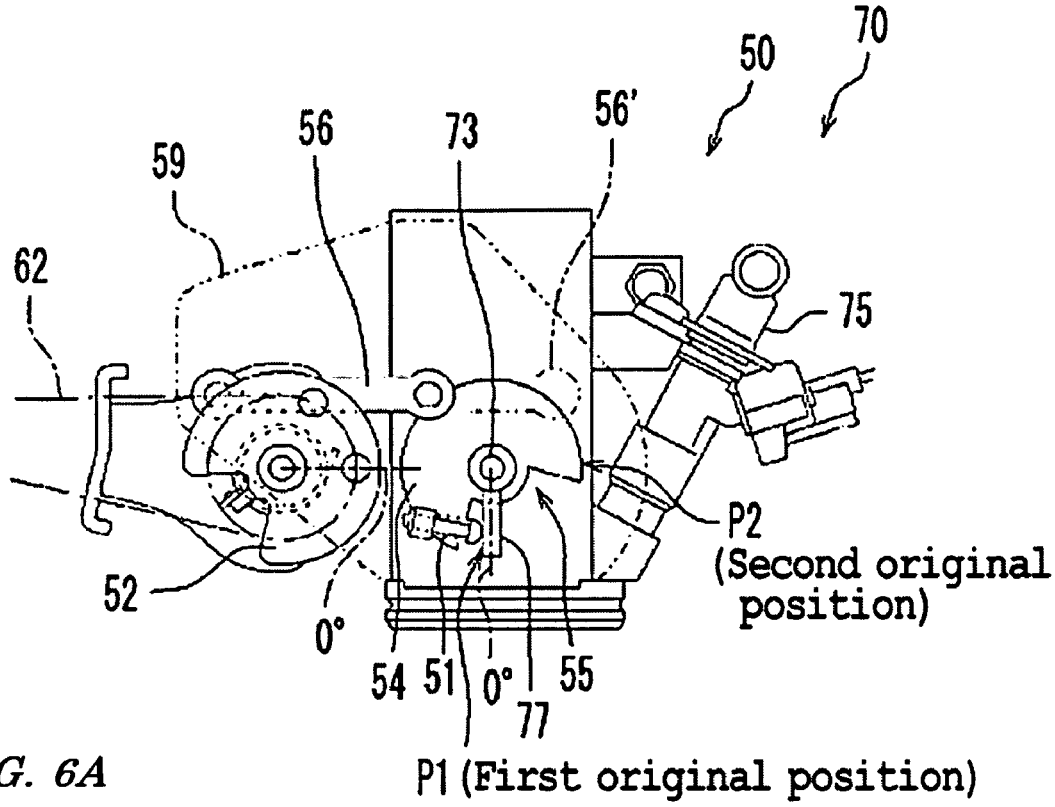
FIGS. 6A and 6B are side views illustrating the operation of an electronic throttle valve system according to the present invention.

As shown in FIG. 6A, the pulley 52 and the lever pulley 54 are connected through the link member 56. The lever pulley 54 includes a notched portion 55 which is substantially in the shape of a sector. The notched portion 55 can come into contact with a protrusion 77 extending from the valve shaft 73 of the throttle valve 71. The protrusion 77 and the lever pulley 54 correspond to a first member and a second member of the present invention, respectively.

In the following description, a position of the protrusion 77 (the first member) when the throttle valve 71 is fully closed (the throttle opening is 0°) is determined as a first original position P1, and a position of the lever pulley 54 (the second member) when the throttle grip 60 (the acceleration controller) is fully closed (the acceleration opening is 0°) is determined as a second original position P2.

The lever pulley 54 is provided with a spring 51 as an elastic body. The spring 51 is designed to be interposed between the protrusion 77 and the lever pulley 54 at least when the lever pulley 54 is located in the second original position P2 (a position when the throttle grip 60 is fully closed). The spring 51 is designed so as to generate a restoring force to return the protrusion 77 to the first original position PI when the lever pulley 54 is located in the second original position P2.

Next, with reference to FIGS. 6 through 8, the operation of the electronic throttle valve system 70 of this embodiment will be described.

Normal Operation

Figure 6B:
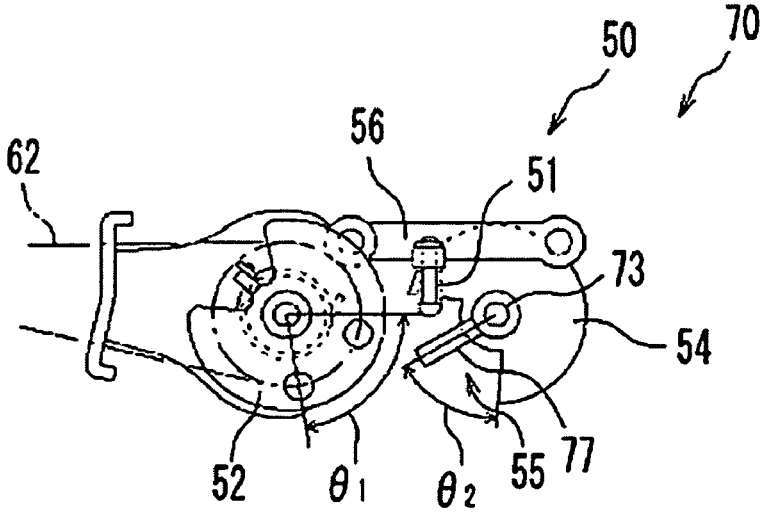
Figure 7A:
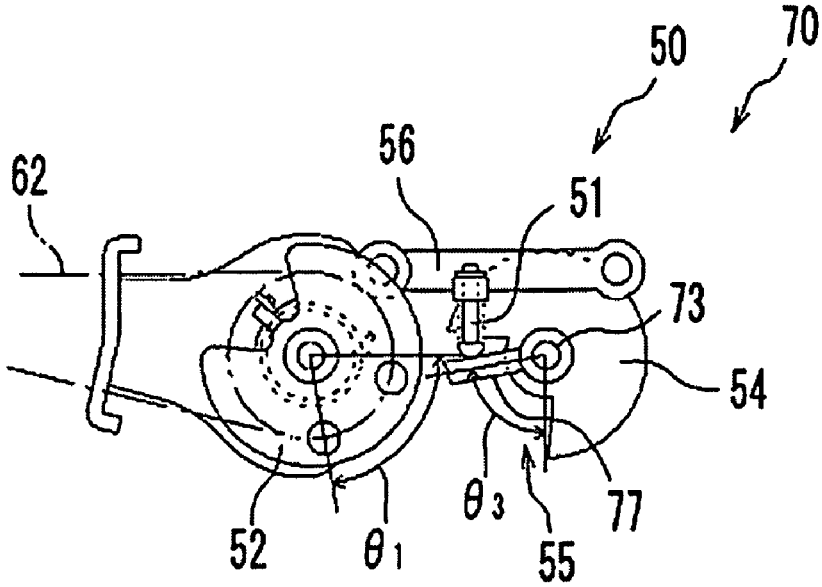
FIGS. 7A and 7B are side views further illustrating the operation of the electronic throttle valve system shown in FIGS. 6A and 6B.
Figure 7B:
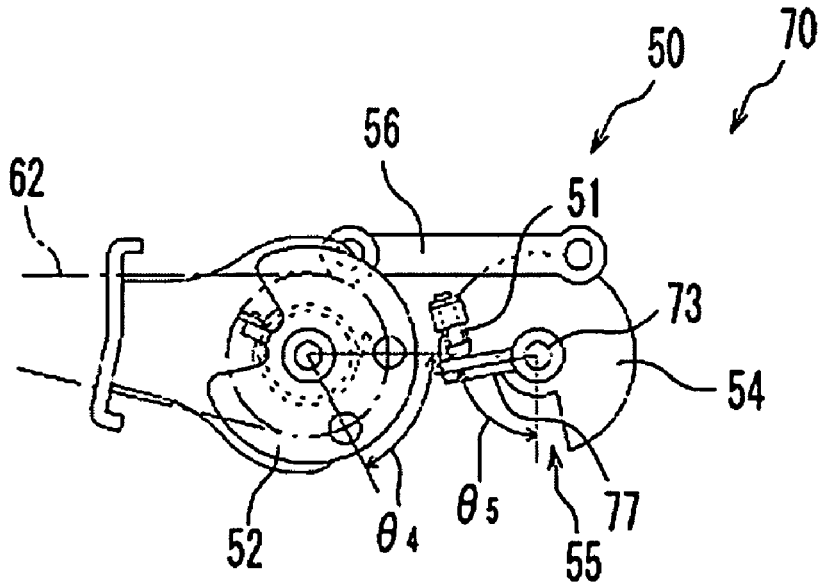
Figure 8A:
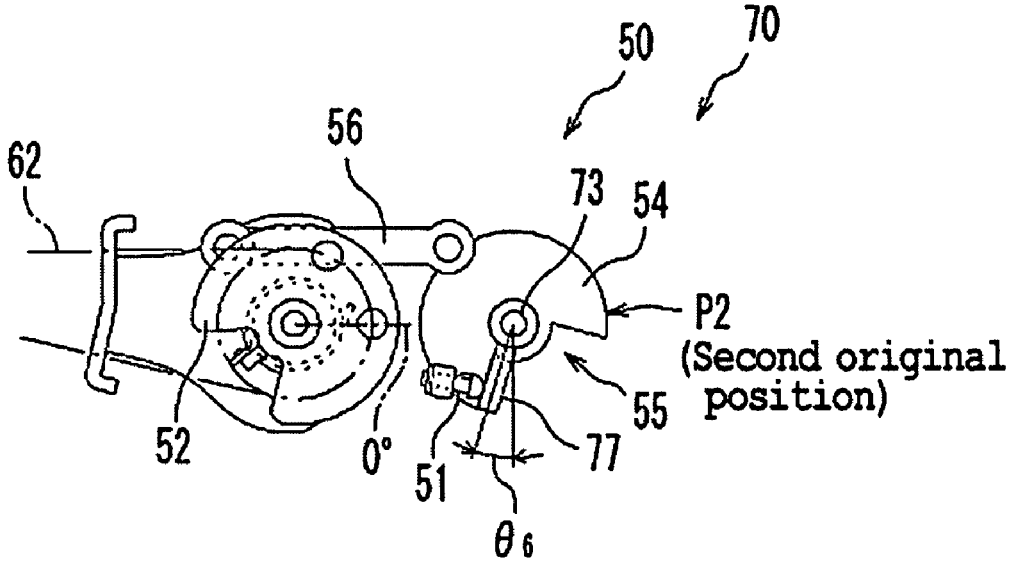
FIGS. 8A and 8B are side views further illustrating the operation of the electronic throttle valve system shown in FIGS. 6A and 6B.
Figure 8B:
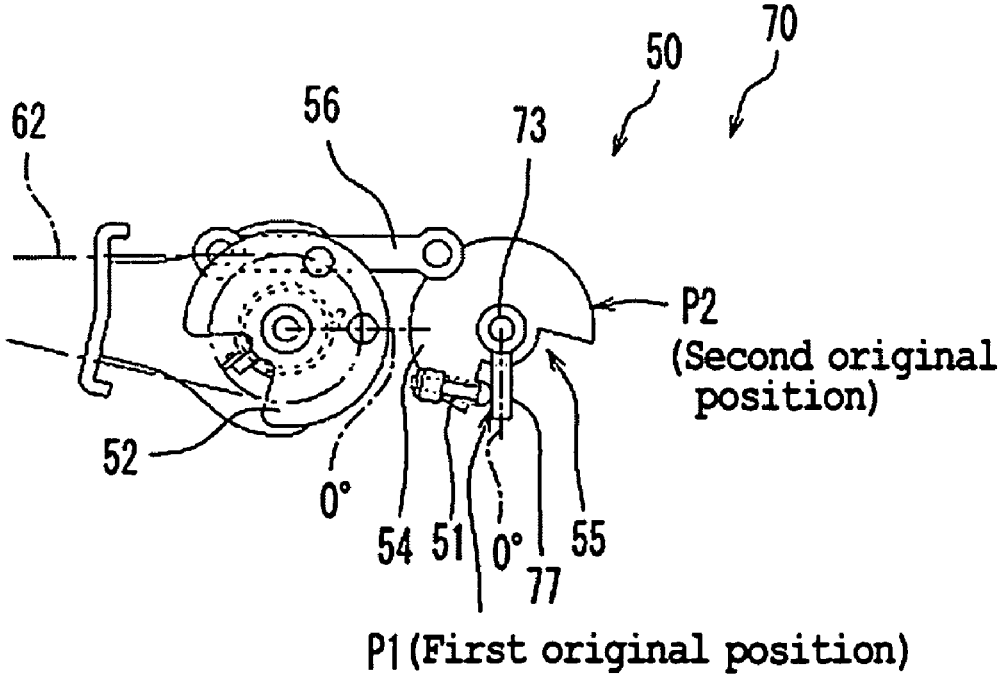

FIG. 6A illustrates the state when the throttle grip 60 and the throttle valve 71 are fully closed (the acceleration opening is 0° and the throttle opening is 0°), in which peripheral members such as the injector 75 and the cover 59 are also shown for a reference purpose. FIG. 6B shows the state immediately after the throttle grip 60 is sharply opened (the acceleration opening is $\theta_1$ (fully opened) and the throttle opening is $\theta_2$, wherein $\theta_{1>\theta 2}$), following the state shown in FIG. 6A. FIG. 7A shows the throttle valve 71 fully opened (the acceleration opening is $\theta_1$ (fully opened) and the throttle opening is $\theta_3$ (fully opened), wherein $\theta_{1=\theta 3}$). FIG. 7B shows the intermediate step of closing the throttle grip 60 sharply (the acceleration opening is $\theta_4$, and the throttle opening is $\theta_5$, wherein $\theta_{1>\theta 4}$ and $\theta_{3>\theta 5}$), following the state of FIG. 7A. FIG. 8A shows the throttle grip 60 further closed (the acceleration opening is 0°, and the throttle opening is $\theta_6$, wherein $\theta_{5>\theta 6}$), following the state of FIG. 7B. FIG. 8B shows that the throttle grip 60 and the throttle valve 71 are fully closed (the acceleration opening is 0°, and the throttle opening is 0°).

In the state shown in FIG. 6A, the pulley 52 has the opening of 0° while the protrusion (claw) 77 has the opening of 0°, the opening of the protrusion 77 being affected by the opening of the throttle valve 71 (opening of the butterfly valve). The link member 56 can move to the point 56' indicated by the dotted line in FIG. 6A if the throttle valve is fully opened.

When the protrusion 77 has the opening of 0°, a distal end of the spring 51, which protrudes from the edge face of the notched portion 55 of the lever pulley 54, generally comes into contact with the protrusion 77. The spring 51 is located so as to generally come into contact with the protrusion 77 when the throttle valve 71 is closed.

When the throttle grip 60 (which is the acceleration controller) is sharply turned so that throttle valve 71 is fully opened from the state shown in FIG. 6A, the mechanical actuating mechanism 50 goes into the state shown in FIG. 6B.

Specifically, when the throttle grip 60 is sharply turned as described above, the torque of the throttle grip 60 is transmitted to the pulley 52 by the throttle cable 62 and the pulley 52 rotates sharply. When the pulley 52 has the opening of $\theta_1$ (e.g. 80°), which is an angle for fully opening the throttle valve 71, the lever pulley 54 also rotates through the link member 56 by the angle of $\theta_1$. This allows the edge face and the spring 51 on the notched portion 55 of the lever pulley 54 to rotate by a predetermined angle in accordance with the angle of $\theta_1$.

On the other hand, as the throttle grip 60 rotates, the accelerator-opening sensor S70 (see FIG. 3) detects the opening of the throttle grip 60 (opening of the accelerator) and sends data thereof to the control device 100. Based on the detected data, the control device 100 controls the electric motor 72 to rotate the valve shaft 73. In this operation, for example, when the valve shaft 73 is rotated by the angle of $\theta_2$ (e.g. 60°), the throttle valve 71 and the protrusion 77, which are fixed to the valve shaft 73, also rotate by the angle of $\theta_2$ (see FIG. 6B).

It should be noted that, when the throttle grip 60 is sharply rotated as described above, the response speed of the lever pulley 54, which is in mechanical connection with the throttle grip 60, is faster than that of the throttle valve 71 and the protrusion 77, which are in electrical connection with the throttle grip 60. This results in the opening $\theta_1$ of the lever pulley 54 becoming greater than the opening $\theta_2$ of the throttle valve 71. In other words, the target opening of the throttle valve 71 becomes greater than the resultant opening, so that the distal end of the spring 51 moves away from the protrusion 77.

After that (e.g. less than 0.1 second later), as shown in FIG. 7A, the protrusion 77 catches up with the distal end of the spring 51. In other words, when the resultant opening of the throttle valve 71 becomes equal to the target opening, the throttle valve is fully opened. The opening $\theta_3$ of the protrusion 77 becomes equal to the opening $\theta_1$ of the pulley 52, that is, e.g. 80°.

Next, as shown in FIG. 7B, when the throttle grip 60 is operated such that the throttle valve 71 is sharply closed, the pulley 52 rotates accordingly through the throttle cable 62. Moreover, in conjunction with the rotation of the pulley 52, the lever pulley 54 rotates. On the other hand, the response speed of the protrusion 77 responding to the operation of the throttle grip 60 is slower than that of the lever pulley 54. As a result, the distal end of the spring 51 catches up with and contacts the protrusion 77.

Under the state that the distal end of the spring 51 and the protrusion 77 contact each other, they move until they reach the state shown in FIG. 8A (the opening of the lever pulley 54 is 0° and the opening of the protrusion 77 is $\theta_6$). When the lever pulley 54 reaches the second original position P2, it stops rotating. After that, only the protrusion 77 is further rotated by the electric motor 72 until the protrusion 77 reaches the first original position PI (see FIG. 8B). This results in the throttle valve 71 being fully closed (the throttle opening is 0°).

Operation Of Mechanical Actuating Mechanism 50 In Abnormal Situations

Next, the operation of the mechanical actuating mechanism 50 in abnormal situations will be described. The mechanical actuating mechanism 50 operates as described below in such abnormal situations that the electric motor 72 stops actuating the throttle valve 71 due to the interruption of the current from the electric motor 72 and the like and that the throttle valve 71 remains open and cannot be closed.

Even when the throttle valve 71 cannot be closed due to malfunction of the electric motor 72, it can be closed by the mechanical actuating mechanism 50. More specifically, in the event that the electric motor 72 stops actuating the throttle valve 71, when the throttle grip 60 is normally turned in such a direction that the throttle valve 71 is closed, the lever pulley 54 which is in mechanical connection with the throttle grip 60, rotates. On the other hand, the protrusion 77 does not move due to stoppage of the electric motor 72. However, by means of rotation of the lever pulley 54, the protrusion 77 contacts the lever pulley 54. Then, as the spring 51 is compressed, the protrusion 77 and the lever pulley 54 are in the state shown in FIG. 7B. After that, the protrusion 77 is pushed and rotated by the edge face and the spring 51 on the notched portion 55 of the lever pulley 54. This results in the throttle valve 71 being closed.

As shown in FIG. 8A, when the lever pulley 54 reaches the second original position P2, the lever pulley 54 stops rotating. Preferably, however, the spring 51 is set to generate a restoring force to return the protrusion 77 to the first original position P1 when the lever pulley 54 is in the second original position P2. Consequently, due to the restoring force of the spring 51, the protrusion 77 is pushed by the spring 51 to return to the first original position P1 (see FIG. 8B).

As described hereinabove, in the event that the electric motor 72 stops actuating the throttle valve 71, the normal rotating operation of the throttle grip 60 allows for compulsory closing of the throttle valve 71.

Gear Shift Change With Blipping

In this two-wheel motor vehicle 1, in a case where a shift control is started when the throttle valve 71 is fully closed, a quick gear shift change is achieved by performing so-called blipping without disengaging the clutch 14. The control device 100 performs the gear shift change with blipping as described below.

When the rider operates the shift up switch 61*a* or the shift down switch 61*b*, a gear shift change command is sent to the control device 100. At this point, the control device 100 determines whether or not the opening of the throttle grip 60 (opening of the accelerator) detected by the accelerator-opening sensor S70 is 0°. If the opening of the accelerator is 0°, the control device 100 performs the gear shift change with blipping.

More specifically, instead of actuating the clutch actuator 18 to disengage the clutch 14, the control device 100 performs so-called blipping in which the electric motor 72 is driven to open the throttle valve 71 sharply so that the rotational speed of the engine is increased temporarily. After the blipping, the control device 100 actuates the shift actuator 16 for the gear shift change without disengaging the clutch 14.

In the above-described blipping, the electronic throttle valve system 70 operates as described below. First, at the start of the gear shift change, the electronic throttle valve system 70 is in the state shown in FIG. 8B. This means that the throttle grip 60 and the throttle valve 71 are both fully closed. Then, the control device 100 drives the electric motor 72 to sharply open the throttle valve 71 in a range that the opening of the throttle valve 71 (the protrusion 77) is less than or equal to $\theta_6$. In other words, the control device 100 drives the electric motor 72 so that the opening of the throttle valve 71 is $\theta_7$ (wherein $\theta_{7<\theta 6}$). As a result, the throttle valve 71 and the protrusion 77 (the first member) are displaced in an open direction from the fully closed state.

As the throttle grip 60 is fully closed at this point, the mechanical, actuating mechanism 50 is not actuated, so that the lever pulley 54 is not rotated by the mechanical, actuating mechanism 50. The spring 51 is designed so as to be elastically deformed until the protrusion 77 returns to a predetermined position (a position in which the throttle opening is $\theta_6$ (see FIG. 8A)) in a case where the protrusion 77 is displaced from the first original position P1 in such a direction that the throttle valve 71 opens when the lever pulley 54 is in the second original position P2. (It should be noted that the value of $\theta_6$ is not particularly specified, but is set to $\theta_6 \geqq 30°$ in this embodiment). This means that the lever pulley 54 is maintained in the second original position P2 as long as the protrusion 77 does not move beyond the predetermined position (a position in which the throttle opening is $\theta_6$ (see FIG. 8A)). Here, even when the control device 100 sharply opens the throttle valve 71 for blipping, a corresponding shock is not transmitted to the rider through the lever pulley 54 and the throttle grip 60.

According to the two-wheel motor vehicle 1 described above, blipping can be performed in a vehicle having an AMT and an electronic throttle valve system 70 to open the throttle valve 71 when the throttle grip 60, which is the acceleration controller, remains in a fully closed state. Accordingly, by blipping during a shift change it is possible to omit disengagement and engagement of the clutch 14. Thus, a quick gear shift change is achieved in the two-wheel motor vehicle 1.

Although blipping is performed instead of disengagement of the clutch 14 in this embodiment, blipping may be performed after disengagement of the clutch 14. In such a case, a shock, which occurs in re-engagement of the clutch after a gear shift change, can be mitigated. This achieves a smooth gear shift change.

Moreover, in reference to two-wheel motor vehicle 1, blipping can be performed using the protrusion 77 (the first member) which is designed to improve responsivity in fully closing control of the throttle valve 71, the lever pulley 54 (the second member) and the spring 51 (the elastic body). Thus, blipping is performed without additionally providing a special blipper for blipping.

Moreover, according to this two-wheel motor vehicle 1, the spring 51 is designed to maintain the lever pulley 54 in the second original position P2 by being elastically deformed until the protrusion 77 is rotated to a predetermined position (a position in which the throttle opening is $\theta_6$ (see FIG. 8A)) in a case where the protrusion 77 is displaced from the first original position P1 in such a direction that the throttle valve 71 opens when the lever pulley 54 is in the second original position P2. In addition, the throttle opening $\theta_6$ is set to be greater than or equal to 30 degrees. In other words, the above predetermined position (a position in which the throttle opening is $\theta_6$ (see FIG. 8A)) is set to be a position in which the protrusion 77 is rotated by greater than or equal to 30 degrees from the first original position P1. This ensures the sufficient opening of the throttle valve 71 during blipping. Thus, blipping may be performed successfully in the two-wheel motor vehicle 1.

Moreover, in the above-described two-wheel motor vehicle 1, the spring 51 is set to generate elastic force to return the protrusion 77 to the first original position P1 when the lever pulley 54 is in the second original position P2. Consequently, in the aforementioned abnormal situation and the like where the throttle grip 60 is closed in a state in which the throttle valve 71 has an opening which is greater than or equal to $\theta_6$, after the lever pulley 54 is displaced to the second original position P2 while pushing the protrusion 77, the protrusion 77 is pushed by the elastic force of the spring 51 to return to the first original position P1. This causes the movement of the throttle valve 71 to slow down just before a fully closed state. Thus a shock which occurs when the throttle grip 60 is returned is mitigated. According to the configuration of this embodiment, both the function of mitigating a shock when the throttle grip 60 is returned and the function of blipping can be achieved simultaneously.

Incidentally, in this embodiment the elastic body according to the present invention is constituted by the spring 51. However, the elastic body according to the present invention is not limited to the spring 51. The elastic body according to the present invention may be a rubber member, for example.

The effect of the spring 51, namely to help actuate the throttle valve 71 smoothly, can be obtained not only in the embodiment in which the pulley 52 and the lever pulley 54 are coupled through the aforementioned link member 56, but also in another embodiment in which the pulley 52 and the lever pulley 54 are coupled coaxially through the shaft portion 53 shown in FIG. 3. Moreover, needless to say, the mitigation of a shock by the spring 51 when the throttle grip 60 is returned is obtained not only in the embodiment in which the pulley 52 and the lever pulley 54 are coupled through the link member 56, but also in another embodiment in which the pulley 52 and the lever pulley 54 are coupled coaxially through the shaft portion 53 shown in FIG. 3.

In this embodiment, the protrusion 77 rotating together with the throttle valve 71 constitutes the first member, and the lever pulley 54 rotating in accordance with the throttle grip 60 constitutes the second member of the present invention. However, components constituting the first member and the second member are not limited to these implementations. For example, the first member may be constituted by a first sliding member which slides in accordance with rotation of the throttle valve 71, and the second member may be constituted by a second sliding member which slides in accordance with rotation of the throttle grip 60.

SECOND EMBODIMENT

The two-wheel motor vehicle 1 according to the present embodiment allows for a so-called cruise control in which running at a constant speed is achieved without operation of the throttle grip 60 by the rider.

The two-wheel motor vehicle 1 according to the present embodiment includes the throttle valve system 70 similar to that of the first embodiment. In the following descriptions, the same components as those of the first embodiment are assigned the same reference numerals and symbols, and their explanations are omitted.

Figure 9:
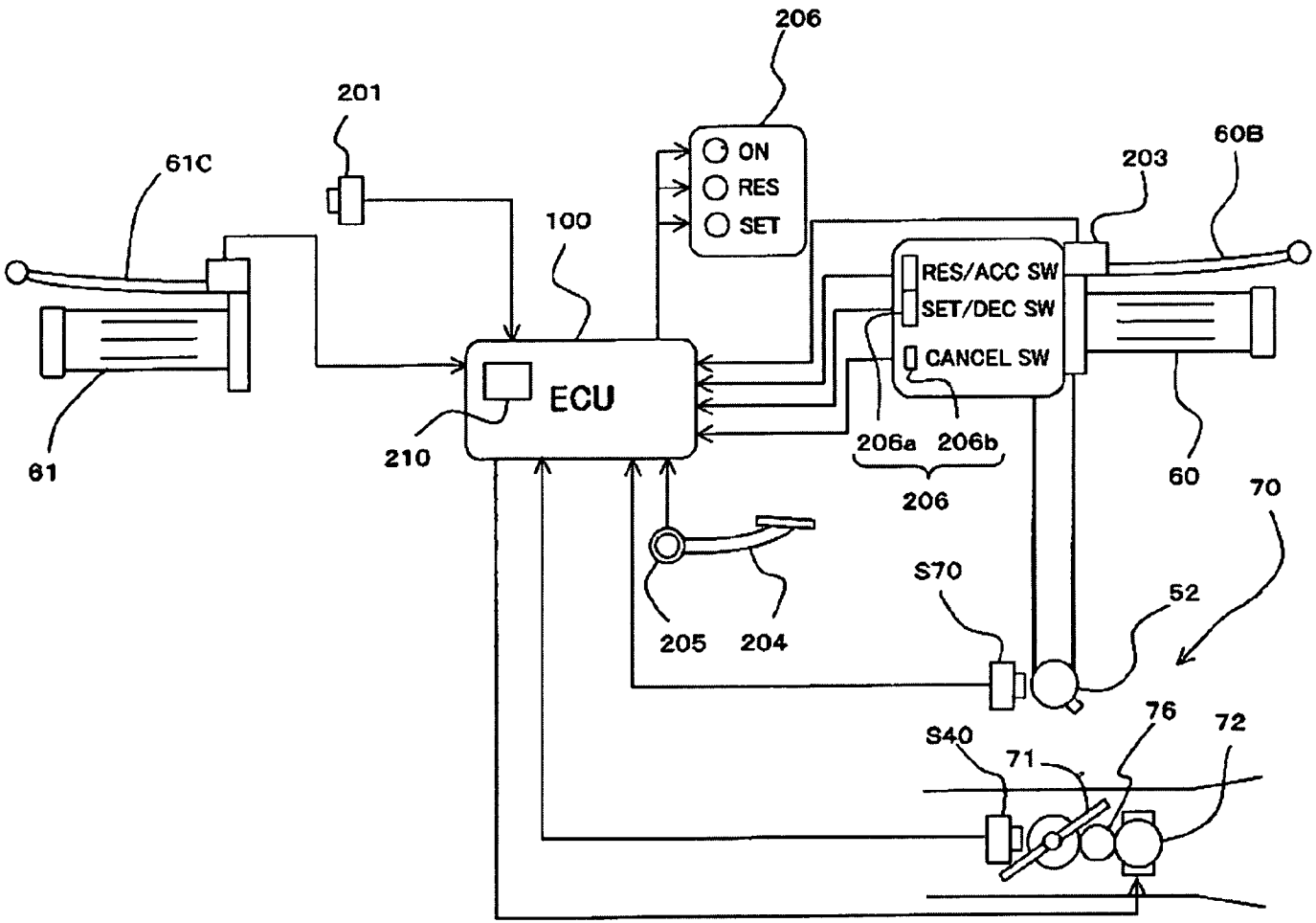
FIG. 9 shows a configuration of a control system according to a second embodiment.

FIG. 9 illustrates a configuration of a control system according to the present embodiment. As shown in FIG. 9, this control system includes the ECU 100 as a control device and a vehicle speed sensor 201. The vehicle speed sensor 201 is a sensor that detects the running speed of two-wheel motor vehicle 1. The specific configuration of the vehicle speed sensor 201 is not limited at all. For example, it may be a sensor that detects the rotation speed of the front wheel 5 or the rear wheel 7, or it may calculate the vehicle speed based on the engine rotation speed. The ECU 100 has a storage device 210 such as a memory.

A switch 206*a* input when a cruise control is started and a switch 206*b* input when the cruise control is stopped are disposed adjacent to the throttle grip 60. The switches 206*a* and 206*b* are connected to the ECU 100. The ECU 100 starts the cruise control when the switch 206*a* is input. On the other hand, the ECU stops the cruise control when the switch 206*b* is input during the cruise control.

The ECU 100 is connected to a brake sensor 203 that detects the input of a front brake 60B and a brake sensor 205 that detects the input of a rear brake 204. Thus, when the rider executes a brake operation, the brake sensor 203 or 205 transmits a signal to the ECU 100, so that the ECU 100 can detect that the brake is applied. The ECU 100 stops the cruise control when it receives a signal from the brake sensor 203 or 205 during the cruise control.

The two-wheel motor vehicle 1 has a display 206 that displays an execution state or a non-execution state of the cruise control.

The cruise control starts when the rider inputs the switch 206*a*. The cruise control is executed by the ECU 100 as follows. The ECU 100 stores in the storage device 210 the vehicle speed at the time when the switch 206*a* is input as a target vehicle speed. Then, the opening of the throttle valve 71 is adjusted so that the vehicle speed detected by the vehicle speed sensor 201 becomes the target vehicle speed. Specifically, the electric motor 72 is controlled so that the vehicle speed becomes the target vehicle speed. In this manner, the cruise control is enabled, and the two-wheel motor vehicle 1 may executes a constant running speed at the target vehicle speed set by the operator.

As shown in FIG. 8A, in reference to two-wheel motor vehicle 1 according to this embodiment, the spring 51 is provided between the protrusion 77 extending from the valve shaft 73 of the throttle valve 71 and the lever pulley 54. Accordingly, the throttle valve 71 is controlled in a range in which the spring 51 can be displaced without opening the throttle grip 60. Thus, in this embodiment, the control of the throttle valve 71 is allowed even when the throttle grip 60 is fully closed, so that cruise control can be executed.

Additionally, a lock mechanism that maintains an open state of the throttle grip 60 may be provided so that the throttle grip 60 is maintained at a predetermined opening (a fixed opening) during the cruise control. In such a case, in FIG. 8A, the rotatable angle of the protrusion 77 becomes larger. In other words, the protrusion 77 can rotate by an angle larger than $\theta_6$. Thus, compared to the case where the throttle grip 60 is fully closed, the control range of the throttle valve 71 becomes larger.

As described above, according to this embodiment, cruise control can be executed.

THIRD EMBODIMENT

In this embodiment, the two-wheel motor vehicle 1 is configured to prevent excessive engine braking without operation of the throttle grip 60 by the rider at a gear down shift during running.

The two-wheel motor vehicle 1 according to the present embodiment includes the throttle valve system 70 similar to that of the first embodiment. In the following descriptions, the same components as those of the first and second embodiments are assigned the same reference numerals and symbols, and their explanations are omitted.

Figure 10:
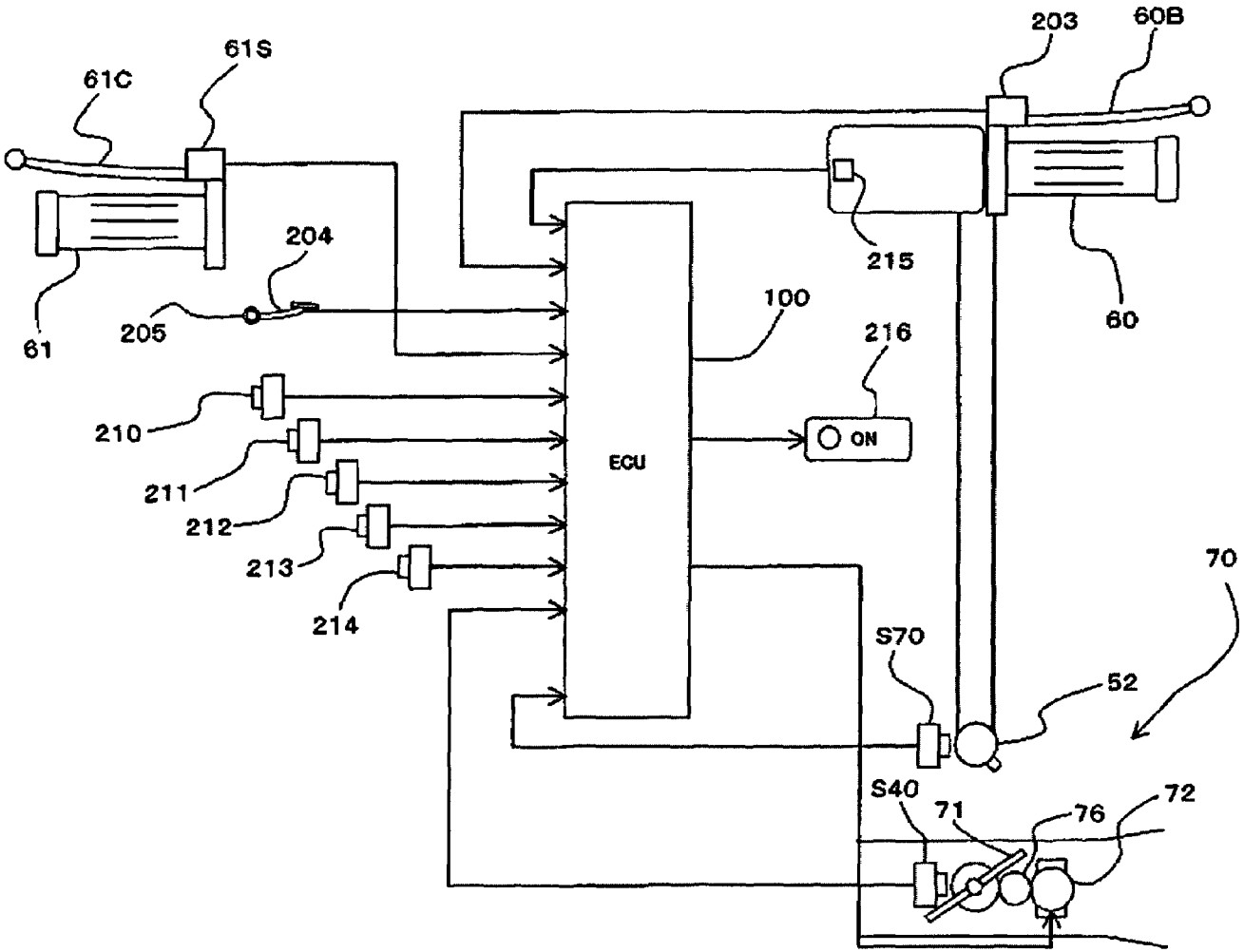
FIG. 10 shows a configuration of a control system according to a third embodiment.

FIG. 10 illustrates a configuration of a control system according to the present embodiment. As shown in FIG. 10, this control system includes the ECU 100 as a control device, a front wheel vehicle speed sensor 213 that detects the rotation speed of the front wheel 5 which is a driven wheel, and a rear wheel vehicle speed sensor 214 that detects the rotation speed of the rear wheel 7 which is a drive wheel. Moreover, this control system includes an engine rotation speed sensor 210 that detects an engine rotation speed, a shift pressure sensor 211 that detects a gear shift pressure, and a position sensor 212 that detects a gear position of the transmission. Moreover, this control system includes the brake sensor 203 that detects the input of the front brake 60B and the brake sensor 205 that detects the input of the rear brake 204 similarly to the second embodiment.

A switch 215 is disposed adjacent to the throttle grip 60. The switch 215 is a switch that executes an ON/OFF operation of the engine brake control described later. When the switch 215 is turned ON, the engine brake control is executed, and when the switch is turned OFF, the engine brake control is not executed. Additionally, the two-wheel motor vehicle 1 according to the present embodiment includes a display 216 that displays an OFF/OFF state of the engine brake control.

Figure 11:
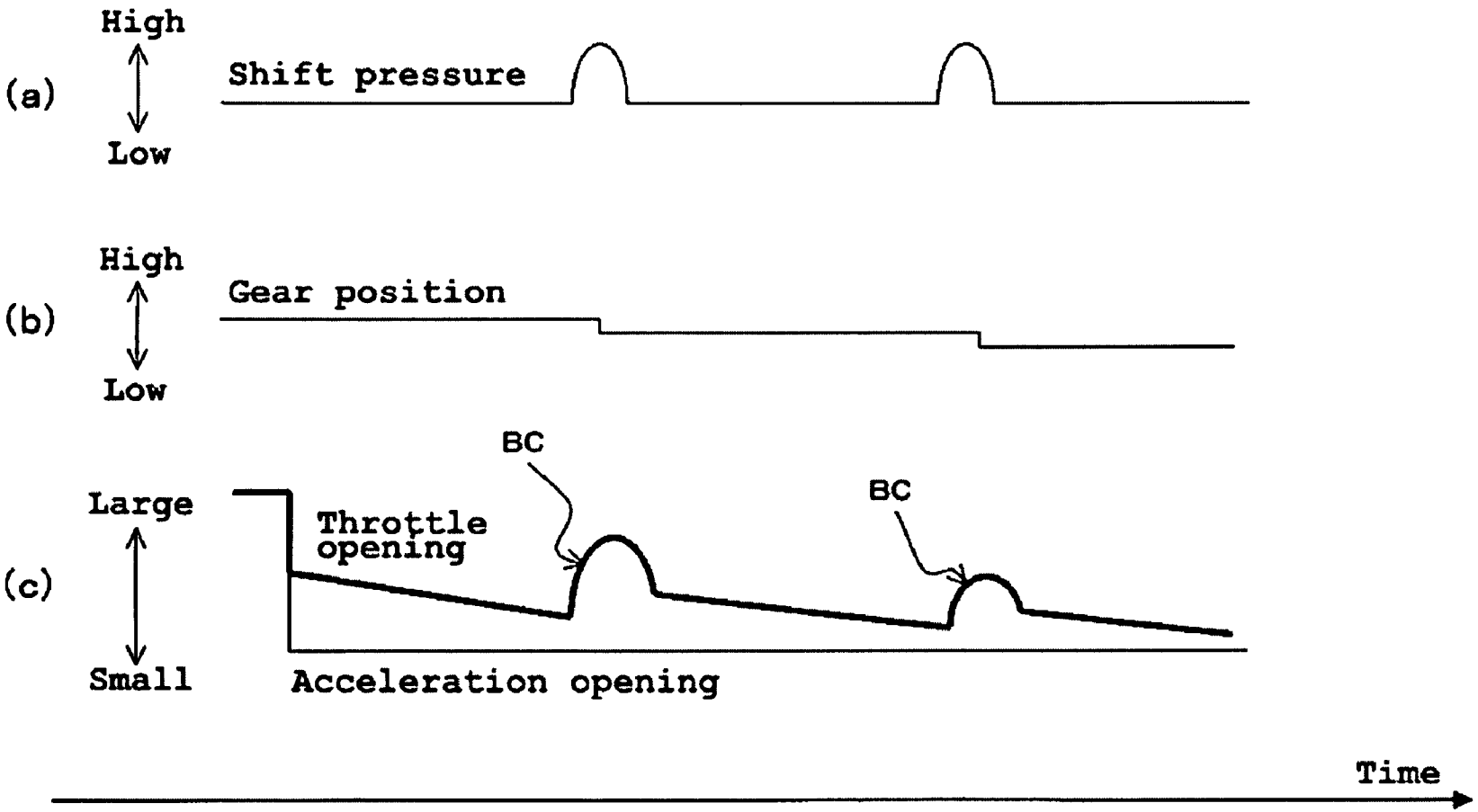

The engine brake control is executed by the ECU 100 as follows. Particularly, ECU 100 compares the rotation speed of the front wheel 5 and the rotation speed of the rear wheel 7 in a case where the shift pressure increases as shown in FIG. 11A or the gear position becomes one step lower as shown FIG. 11B, and when the speed difference between the front wheel 5 and the rear wheel 7 exceeds a predetermined value, the ECU 100 makes the opening of the throttle valve 71 larger temporarily by controlling the electric motor 72 (refer to the reference symbol BC in FIG. 11C). This enables the rotational engine speed to increase temporarily at a gear down shift, so that the speed difference is maintained not greater than the predetermined value. This results in prevention of excessive engine braking.

As described before, in the two-wheel motor vehicle 1 according to this embodiment, the spring 51 is provided between the protrusion 77 extending from the valve shaft 73 of the throttle valve 71 and the lever pulley 54 (refer to FIG. 8A). Accordingly, the throttle valve 71 is controlled in a range in which the spring 51 can be displaced without opening the throttle grip 60. Thus, in this embodiment, excessive engine braking is prevented without operation of throttle grip 60 by the rider. Specifically, an automatic prevention of excessive engine braking can be executed at a gear down shift.

Incidentally, there could be a case that the wheel diameter is different between the front wheel 5 and the rear wheel 7. Thus, in comparing the rotational speed of the front wheel 5 and that of the rear wheel 7, the difference of the wheel diameter between these wheels is preferably considered. For example, the rotational speed may be defined as a rotation angle per unit time (rad/s), and moreover, compensation may be made in accordance with the wheel diameter. Also, the above predetermined value, which is a standard speed difference in executing the engine brake control, may be set to a value previously determined in consideration of the difference of the wheel diameter between the front wheel 5 and the rear wheel 7.

As described above, in a straddle type vehicle having an electronic throttle valve, various advanced controls can be achieved compared to conventional vehicles as illustrated in the first to third embodiments according to the present invention.

Straddle type vehicles according to the present invention are not limited to two-wheel motor vehicles. Other than two-wheel motor vehicles, the invention is also applicable to, for example, four-wheeled buggies (ATV: All Terrain Vehicle) and snowmobiles.

While several embodiments have been described in connection with the figures hereinabove, the invention is not limited to these embodiments, but rather can be modified and adapted as appropriate. Thus, it is to be clearly understood that the above description was made only for purposes of an example and not as a limitation on the scope of the invention as claimed herein below.

What is claimed:

1. A straddle type vehicle, comprising:

an electronically and mechanically controllable throttle valve for adjusting the amount of air intake of an engine;

a first member displaced together with the throttle valve in a state in which a position of the first member when the throttle valve is fully closed is set as a first original position;

a second member displaced in accordance with an acceleration controller in a state in which a position of the second member when the acceleration controller is fully closed is set as a second original position; and an elastic body operatively coupled between the first member and the second member when at least the first member and the second member are in the first original position and the second original position, respectively, the elastic body generating a restoring force to return the first member to the first original position when the second member is in the second original position, and maintaining the second member in the second original position by being elastically deformed until the first member reaches a predetermined position when the first member is displaced from the first original position in a direction in which the throttle valve opens in a state in which the second member is in the second original position.

2. A straddle type vehicle, comprising:

a throttle valve for adjusting the amount of air intake of an engine;

an acceleration controller for opening and closing the throttle valve and configured for operation by a rider;

an electric motor for actuating the throttle valve;

a first member displaced together with the throttle valve, the first member having a first original position when the throttle valve is fully closed;

a second member displaced in response to the acceleration controller, the second member having a second original position when the acceleration controller is fully closed;

an elastic body interposed between the first member and the second member when at least the first member and the second member are in the first original position and the second original position, respectively, the elastic body generating a restoring force to return the first member to the first original position when the second member is in the second original position, and maintaining the second member in the second original position by being elastically deformed until the first member reaches a predetermined position when the first member is displaced from the first original position to a direction in which the throttle valve opens in a state in which the second member is in the second original position; and a control device responsive to a predetermined control signal, the control device being configured to open the throttle valve by driving the electric motor and displacing the first member until the first member reaches at most the predetermined position in response to the predetermined control signal.

3. The straddle type vehicle according to claim 1, further comprising:

a multistage transmission;

an input device for receiving a shift change command from the rider; and a shift actuator for driving the transmission to perform a shift change when the shift change command is input in the input device, wherein the predetermined control signal is a control signal generated when a gear shift change is performed by the shift actuator when the acceleration controller is fully closed.

4. The straddle type vehicle according to claim 1, further comprising:

a vehicle speed sensor, wherein the predetermined control signal is a signal for adjusting the opening of the throttle valve in a range in which the first member is positioned between the first original position and the predetermined position and so that the vehicle speed becomes a predetermined value.

5. The straddle type vehicle according to claim 1, further comprising:

a multistage transmission;

a drive wheel;

a driven wheel;

a first sensor for detecting the rotational speed of the drive wheel; and a second sensor for detecting the rotational speed of the driven wheel, wherein the predetermined control signal is a signal for adjusting the opening of the throttle valve so that the difference between the rotational speed of the drive wheel and the rotational speed of the driven wheel is not greater than a predetermined value at a down shift of the transmission.

6. The straddle type vehicle according to claim 1, wherein the first member is configured as a first rotating body for rotating together with the throttle valve, and the second member is configured as a second rotating body for rotating in response to the operation of the acceleration controller.

7. The straddle type vehicle according to claim 6, further comprising:

a handle bar with a throttle grip;

a throttle cable coupled to the throttle grip;

a pulley with which the throttle cable is engaged; and a valve shaft for supporting the throttle valve in a freely rotatable manner, wherein the acceleration controller functions as the throttle grip, the first rotating body is connected to the valve shaft directly or indirectly so as to operate in conjunction with the valve shaft, and the second rotating body is connected to the pulley directly or indirectly so as to operate in conjunction with the pulley.

8. The straddle type vehicle according to claim 1, wherein the predetermined position is set to a position in which the first member may be rotated by at least 30 degrees from the first original position.

9. The straddle type vehicle according to claim 1, wherein the second member is displaced toward the second original position while pressing the first member through the elastically deformed elastic body when the acceleration controller is closed from a state in which the first member is displaced in the direction in which the throttle valve is opened beyond the predetermined position, and after the second member reaches the second original position, the first member is pressed to reach the first original position due to the restoring force of the elastic body.

* * * * *